US012385269B2

(12) United States Patent
Tecu et al.

(10) Patent No.: US 12,385,269 B2
(45) Date of Patent: Aug. 12, 2025

(54) DUAL POOL SAFETY COVER WITH PROTECTION PROTOCOL

(71) Applicant: Bond Consulting Services, Inc., Mead, CO (US)

(72) Inventors: Kirk Steven Tecu, Longmont, CO (US); Duncan Doyle, Denver, CO (US); Sean Michael Shiers, Mead, CO (US)

(73) Assignee: Bond Consulting Services, Inc., Mead, CO (US)

( * ) Notice: Subject to any disclaimer, the term of this patent is extended or adjusted under 35 U.S.C. 154(b) by 361 days.

(21) Appl. No.: 18/175,085

(22) Filed: Feb. 27, 2023

(65) Prior Publication Data

US 2023/0272636 A1 Aug. 31, 2023

Related U.S. Application Data

(60) Provisional application No. 63/268,643, filed on Feb. 28, 2022.

(51) Int. Cl.
*E04H 4/10* (2006.01)

(52) U.S. Cl.
CPC ..... *E04H 4/10* (2013.01)

(58) Field of Classification Search
CPC ..... E04H 4/10; E04H 4/101
USPC ..... 4/498
See application file for complete search history.

(56) References Cited

U.S. PATENT DOCUMENTS

2020/0370319 A1* 11/2020 Shebek ..... E04H 4/101

* cited by examiner

*Primary Examiner* — Lauren A Crane
(74) *Attorney, Agent, or Firm* — Trenner Law Firm, LLC; Mark Trenner

(57) ABSTRACT

A pool double safety cover with at least one protection protocol includes a first cover that is substantially impermeable to water, and a second cover that is substantially permeable to water. A track system having independent parallel tracks is provided for guiding the first cover and the second cover to open and close over a pool. At least one interlock switch is configured to generate a signal indicating whether the first cover and the second cover is in a fully open or fully closed state. A drive system is configured to open and close the first cover and the second cover over the pool according to a protection protection protocol based on feedback from the interlock switch and at least one sensor. In another example, the protection protocol is a freeze protection protocol. In another example, the protection protocol is a precipitation protection protocol.

20 Claims, 8 Drawing Sheets

DUAL POOL SAFETY COVER WITH PROTECTION PROTOCOL

PRIORITY CLAIM

This application claims the priority filing benefit of U.S. Provisional Patent Application No. 63/268,643 filed Feb. 28, 2022 for "Dual Pool Safety Cover With Freeze Protection" of Kirk Steven Tecu, et al., hereby incorporated by reference in its entirety as though fully set forth herein.

BACKGROUND

For many modern residential pools, safety covers are installed to prevent unintentional pool entry. Other benefits include, but are not limited to, water heat retention and providing a barrier to debris. Typically, a pool is "winterized" prior to cold temperatures to help reduce or prevent freezing of external pool components. However, a pool owner may want to keep their pool open later in the fall or winter season, or open the pool earlier in the spring season. This increases the risk of freeze damage when the weather changes quickly.

DETAILED DESCRIPTION

A pool double safety cover is disclosed as it may implement a protection protocol, that gives the pool owner the flexibility to have the pool open later in the fall/winter season and/or earlier in the spring season, while reducing or altogether eliminating freeze damage and/or damage from precipitation accumulation on the cover, e.g., when the weather suddenly changes. Freeze protection and precipitation protection may be implemented together for the same cover, or a cover may only have one or the other.

An example pool double safety cover implementing a protection protocol includes a cover that is substantially impermeable to water, and another cover that is substantially permeable to water. The example pool double safety cover also includes a track system for guiding the covers to open and close over a pool. One or more interlock switches are configured to generate a signal indicating whether the covers are in a fully open or fully closed state. A drive system opens and closes one or both covers over the pool according to a freeze protection protocol and/or a precipitation protection protocol. The protocol may be implemented based at least in part on feedback from the interlock switch(es), a temperature sensor, and/or a precipitation sensor. Additional or other types and/or numbers of sensors or other feedback units may also be provided. Examples include but are not limited to sensors that measure air temperature, water temperature, rainfall, rain accumulation, time, and even feedback units that receive weather forecasts.

Before continuing, it is noted that as used herein, the terms "includes" and "including" mean, but is not limited to, "includes" or "including" and "includes at least" or "including at least." The term "based on" means "based on" and "based at least in part on."

Although the terms first and second are used herein to refer to separate covers, there is no meaning assigned to the terms first and second other than to distinguish one from the other.

It is also noted that the examples described herein are provided for purposes of illustration, and are not intended to be limiting. Other devices and/or device configurations may be utilized to carry out the operations described herein.

Figure 1:
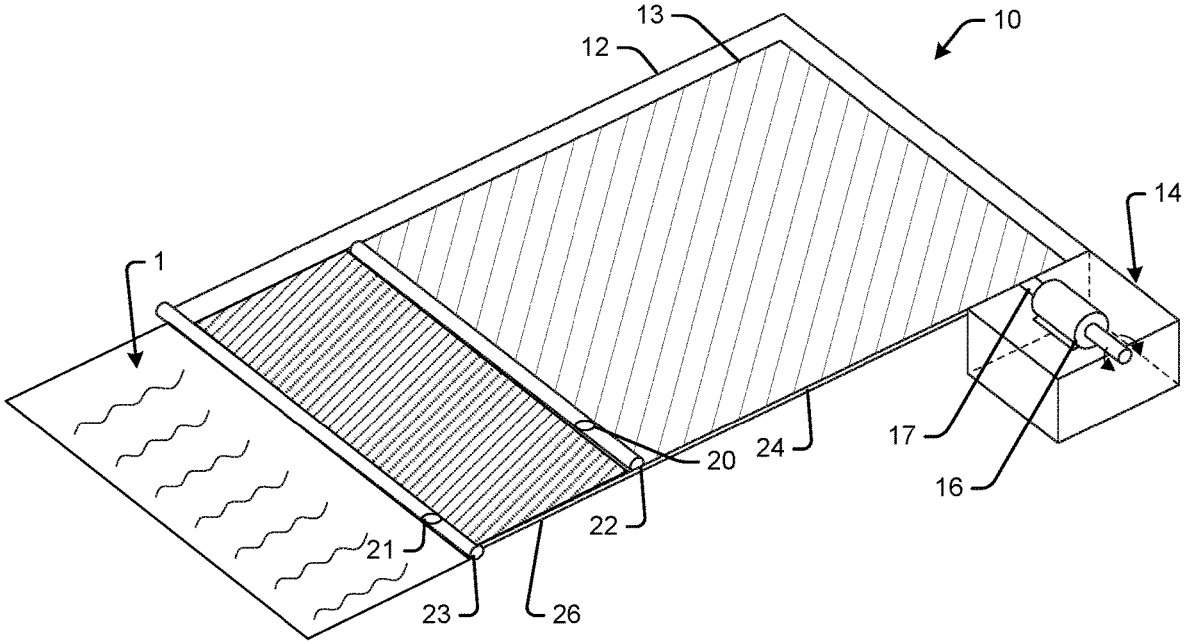
FIG. 1 is an illustration showing an example pool safety cover as it may be installed on a swimming pool.

FIG. 1 is an illustration showing an example pool safety cover 10 as it may be installed over the water of a swimming pool 1 and implement a protection protocol. An example installation of an automated version of a safety cover 10 includes a track system 13 (partially shown in FIG. 1) bonded to the edges 12 of the pool 1. The track system 13 allows the cover 10 to be pulled open/closed by a drive system 14. The drive system may include one or more electric motors 16. The motor 16 is controlled by a user via a remote cover/uncover switch. It is noted that the motor 16 may be a single drive motor, a dual drive motor, and/or independent motors may be provided to separately operate the separate covers. This allows a pool user to open the cover 10 fully for use, then close the cover 10 when not attended.

Figure 2:
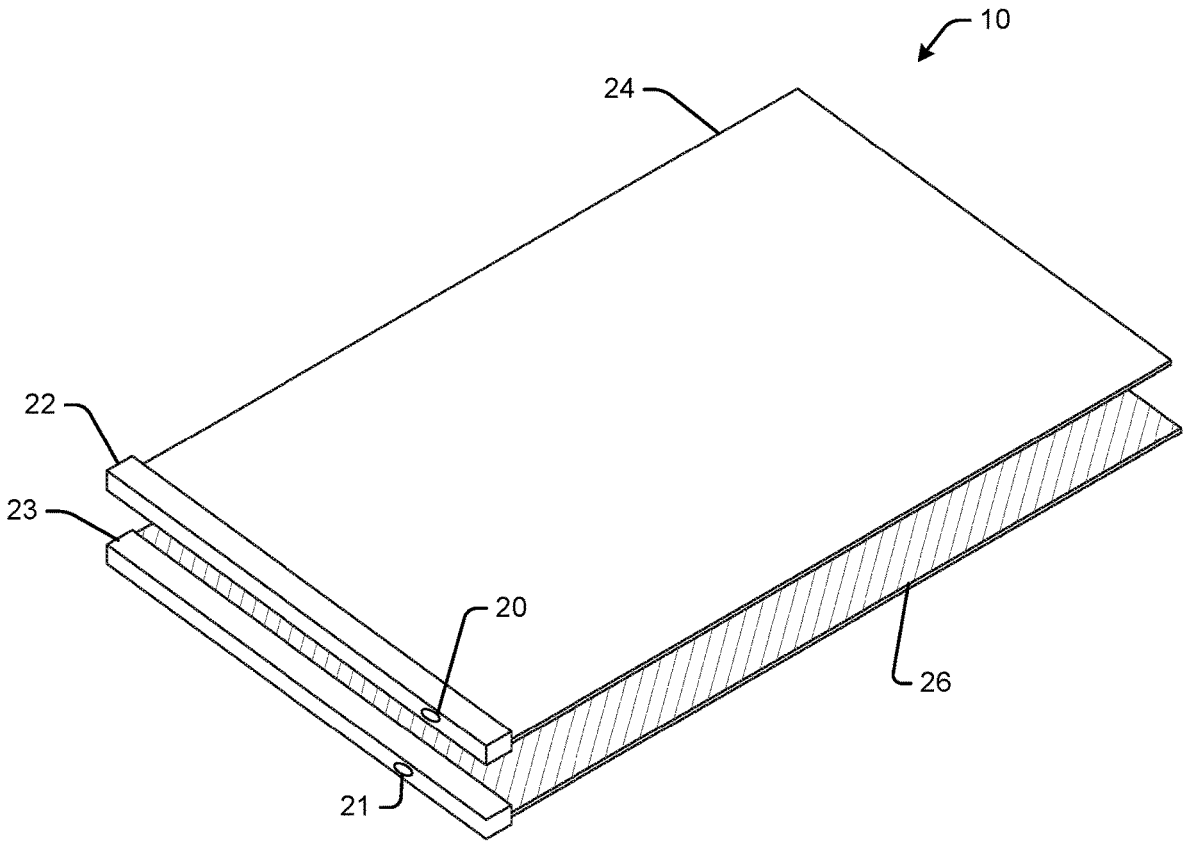
FIG. 2 is a perspective view of an example pool double safety cover having interlock switches.

FIG. 2 is a perspective view of an example pool double safety cover 10 having interlock switches 20, 21 for implementing a protection protocol. The interlock switches 20, 21 may be pressure switches, light sensors, etc., that generate a signal indicating whether the pool cover is in an open or closed state. In this example, the interlock switches 20, 21 are shown as these may be installed on the leading edge or bars 22, 23 of each pool cover 24, 26.

The pool covers may include a non-permeable cover 24 which may be a safety cover (e.g., providing a barrier to entry), and a permeable cover 26. The water permeable cover 26 may be manufactured of a water permeable material, such as a mesh. The water permeable cover 26 may each include a leading edge 22, 23 that rides in a track system 13 so that the respective covers 24, 26 can be moved across the pool, e.g., to open and close the covers on the pool 1. In an example, the water permeable cover 26 and the safety cover 24 are operated by one or more drive motor(s) 16 of the drive system 14.

An example track system 13 includes two separate parallel tracks (e.g., sideways oriented U-channels stacked on top of each other in which the covers ride in) along the length of the pool edges. The tracks may extend forward from the drive motor 16 and drive shaft or spool shown 17 in FIG. 1). The separate tracks may be provided for a non-permeable safety cover 24 in one track, and a water permeable cover 26 in a second track. For example, the upper track may include the safety cover 24, and the lower track may include the water permeable cover 26. In another example, the covers 24, 26 may be reversed with the safety cover 24 in the lower track and the water permeable cover 26 in the lower track.

Each cover may have its own spool 17 and independent motors for fully independent operation. This enables the pool owner to select which properties they want to provide for the pool 1. For example, the user can close the safety cover 24 to provide a barrier to entry, pool water heat retention, and serve as a barrier to debris and water (e.g., rain/snow) entry. The water permeable cover 26 may be closed to provide a barrier to entry (e.g., as a safety cover), while allowing heat to escape to the atmosphere and reduce temperature build-up, for rainwater to flow through into the pool 1, and still provide a barrier for debris. Lights can still be seen through the mesh, and external fountains can still be operated and allowed to empty into the pool 1 through the mesh.

An example of freeze protection may be implemented to reduce or prevent external components from freezing when the ambient temperature and/or water temperature is lower than a predetermined temperature or threshold temperature. Example external components may include any pool and/or accessory component with a water line that has not been winterized, such as but not limited to deck jets, laminars, raised spa waterfalls, waterfalls, slides, to name only a few examples.

An example protection protocol includes using the secondary or permeable cover 26 to enable water (e.g., from the external components and/or precipitation) to flow through the mesh and into the pool 1, while still keeping debris out of the pool 1. The permeable cover 26 may also serve as a barrier to pool entry (e.g., as a secondary safety cover).

Typically, for safety reasons, both the non-permeable and the permeable cover 24, 26 may need to be fully closed before applying the protection protocol. For example, a safety protocol may be implemented so as not to inadvertently close the cover(s) over someone who is swimming in the pool.

Interlock sensor(s) 20, 21 may be installed to help ensure that both covers 24, 26 are fully closed. Any suitable interlock sensor(s) 20, 21 may be installed on the cover in any suitable location. For example, the interlock sensor(s) 20, 21 may include pressure switches at the end of the rail system, opposite the cover motor box. When the leading edge of the cover moves to the fully closed position, the pressure switch is activated. Other switches, sensors, and/or feedback units may be provided, as will be readily understood by those having ordinary skill in the art after becoming familiar with the teachings herein.

Figure 3:
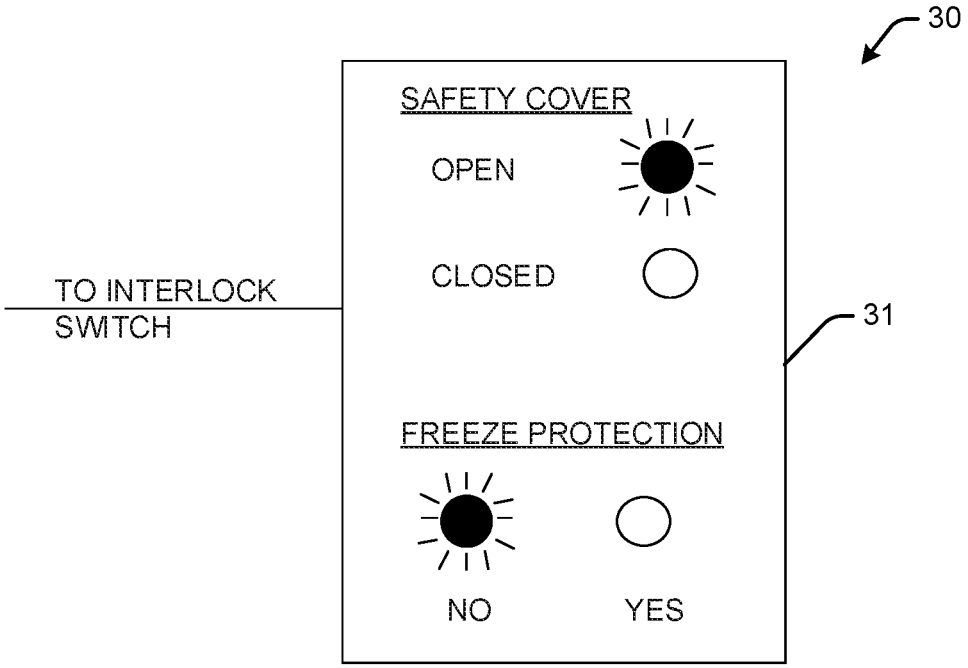
FIG. 3 illustrates example control electronics to implement a protection protocol for the example pool double safety cover.
Figure 3:
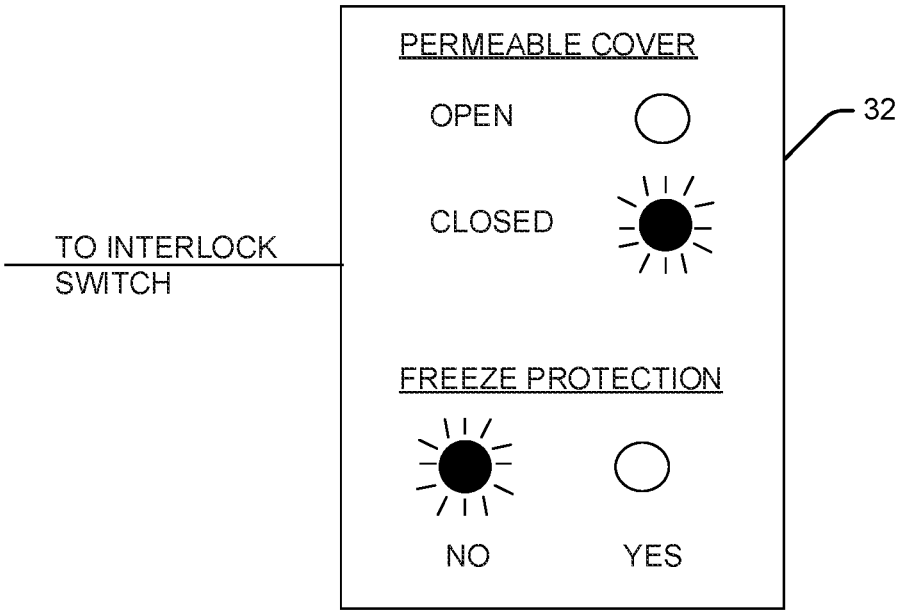

User feedback based on the interlock sensor(s) 20, 21 may be provided at the cover controller box, such as that shown in FIG. 3. FIG. 3 illustrates example control electronics 30 to implement a protection protocol for the example pool double safety cover 10. A user interface 31 is provided for the safety cover 24, and another user interface 32 is provided for the permeable cover 26. It is noted that the user interfaces 31, 32 may be graphical user interfaces in a dedicated device, interfaces on a mobile phone app or computer software, and/or hardware (e.g., installed near the pool including lights to indicate the state of the covers).

Figure 4:
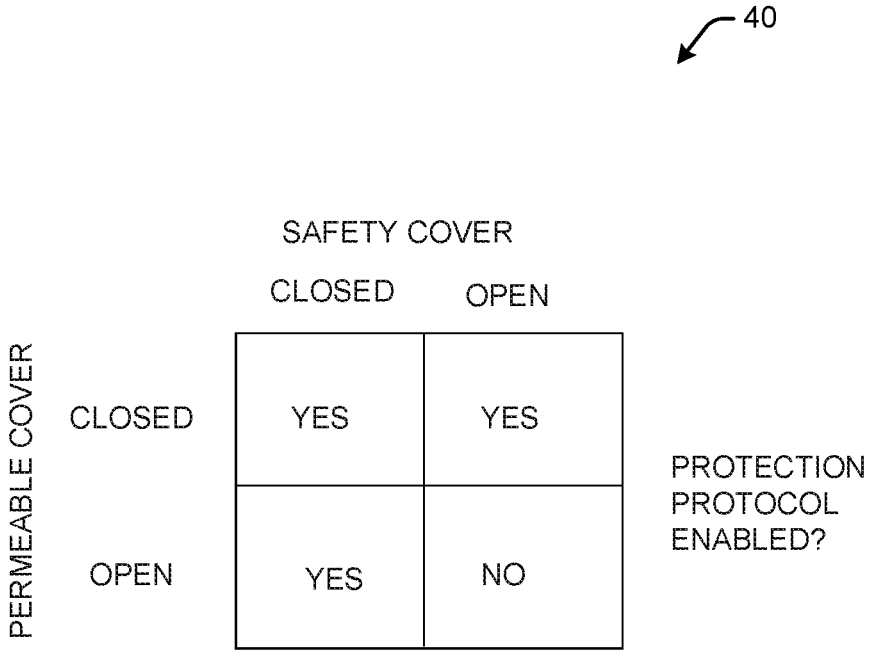
FIG. 4 illustrates example logic of a protection protocol for the example pool double safety cover.

FIG. 4 illustrates example logic of a protection protocol 40 for the example pool double safety cover 10. It is noted that similar logic may be implemented for precipitation protection. In this example, operating the covers 24, 26 according to a protection protocol is only enabled, for safety reasons, when both covers are already fully closed or at least one of the covers is fully closed, indicating that no one is currently in the pool 1.

In an example, a drive system 14 opens and closes the cover 24 and the cover 26 over the pool 1 according to the protection protocol based on feedback from the at least one interlock switch 20, 21 and the temperature sensor and/or precipitation sensor. In an example, the sensor(s) may also be provided as part of the interlock switch 20, 21.

In an example, control logic is operatively associated with the drive system 14 to open and close the cover 24 and the cover 26. Control logic may be embodied as electronic circuitry and/or software/firmware (program code) executable to generate control signals (e.g., to actuate the drive motor 16). The control logic is configured to receive a signal from the interlock switch 20, 21 and the temperature sensor and/or precipitation sensor. The control logic is further configured to actuate the drive system 14 to operate the cover 24 and the cover 26 according to the protection protocol. The protection protocol may include computer-readable instructions and/or hard coded in electronics/circuitry.

The control logic may further actuate external pool accessories. In an example, the external pool accessories are turned on automatically when both covers 24, 26 are in a fully open state according to the freeze protection protocol. This helps to maintain water flow through the water lines of the external pool accessories, and reduces freezing of the external pool accessories.

In an example freeze protection protocol, the non-permeable cover 26 is automatically opened when both covers 24, 26 are in a fully closed state.

In an example, external pool accessories are turned on automatically after opening the non-permeable cover 24 to maintain water flow through water lines and reduce freezing of the external pool accessories according to the freeze protection protocol.

In an example, the drive system 14 includes at least one motor 16 operated by the control logic to automatically open and close the cover 24 and the cover 26 over the pool 1. In an example, the drive system 14 includes independent motors to separately open and close the cover 24 and the cover 26 over the pool 1.

In an example, the cover 24 can be open when the cover 26 is closed. The cover 24 can be closed when the second cover 26 is open. Both the covers 24, 26 can be open and closed at the same time. The position of the covers 24, 26 determines an outcome of the protection protocol.

In an example, the control logic is operatively associated with the cover 24 and the cover 26. The control logic is configured to receive a signal from the at least one interlock switch 20, 21 and actuate operation of the cover 24 and/or the second cover 26 according to a precipitation protection protocol based on feedback from at least one precipitation sensor.

In an example, a precipitation sensor provides information about possible precipitation accumulation on the impermeable cover 24. The drive system 14 is configured to open and close the cover 24 and the second cover 26 over the pool 1 according to a precipitation protection protocol based on feedback from the precipitation sensor and the at least one interlock switch 20, 21.

FIGS. 5-8 shows example operations to implement a protection protocol for the example pool double safety cover 10. The operations shown and described herein are provided to illustrate example implementations. It is noted that the operations are not limited to the ordering shown. Still other operations may also be implemented.

It is noted that the covers 24, 26 may be oriented in two different ways. For example, the non-permeable cover 24 may be provided above the permeable cover 26, or the permeable cover 26 may be provided above the non-permeable cover 24. The following logic is explained with regard to such a scene. It is understood, however, that this logic may be extended for any configuration of two or more covers.

Figure 5:
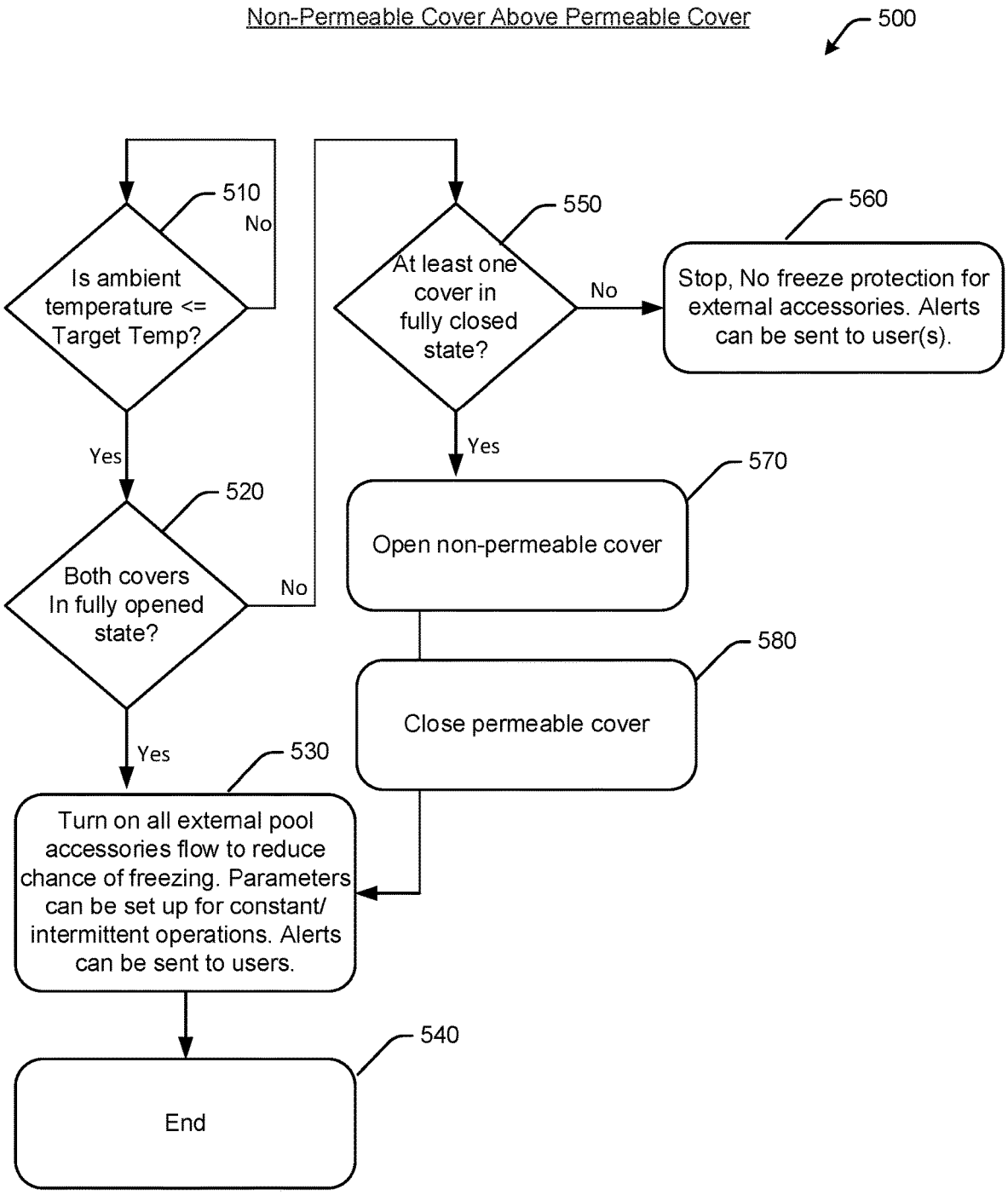
FIGS. 5-8 shows example operations to implement a protection protocol for the example pool double safety cover.

FIG. 5 illustrates example operations when the user is currently using the pool 1 and both covers 24, 26 are fully opened. The freeze protection logic can take effect without movement of either cover. But for safety reasons, the automatic cover movement may only take place when both covers 24, 26 are closed and remote freeze protection is enabled. This may require a secondary interlock system to ensure that the "fully open" state of both covers 24, 26 is detected.

Operations 500 include operation 510 checking if the temperature monitored by the sensor exceeds a target temperature (e.g., indicating freezing or potentially freezing conditions). Operation 520 includes checking if both covers 24, 26 are in a fully open state. If both covers 24, 26 are in a fully open state, then external pool accessories may be turned on in operation 530, at least at a drip rate, to reduce the chance of freezing pipes. Optionally, the permeable cover may be closed. Parameters can be set up (e.g., by the user) for constant and/or intermittent operations (e.g., turning the water flow on and/or off). Alerts may also be issued to the user, e.g., via text message or a mobile phone app. Operations end at 540.

If both covers 24, 26 are not in a fully open state, then operation 550 includes checking if at least one of the covers 24, 26 is in a fully closed state. If at least one of the covers 24, 26 is not in a fully closed state, this indicates someone may be in the pool 1. Operations stop at 560 and freeze protection is not available for safety reasons. Alerts may be issued to the user.

If at least one of the covers 24, 26 is in a fully closed state (i.e., no one is in the pool 1), operation 570 includes opening the non-permeable cover (if this is closed) and/or optionally closing the permeable cover at 580 (if this is closed). Freeze protection may proceed at operation 530 and end at 540.

Figure 6:
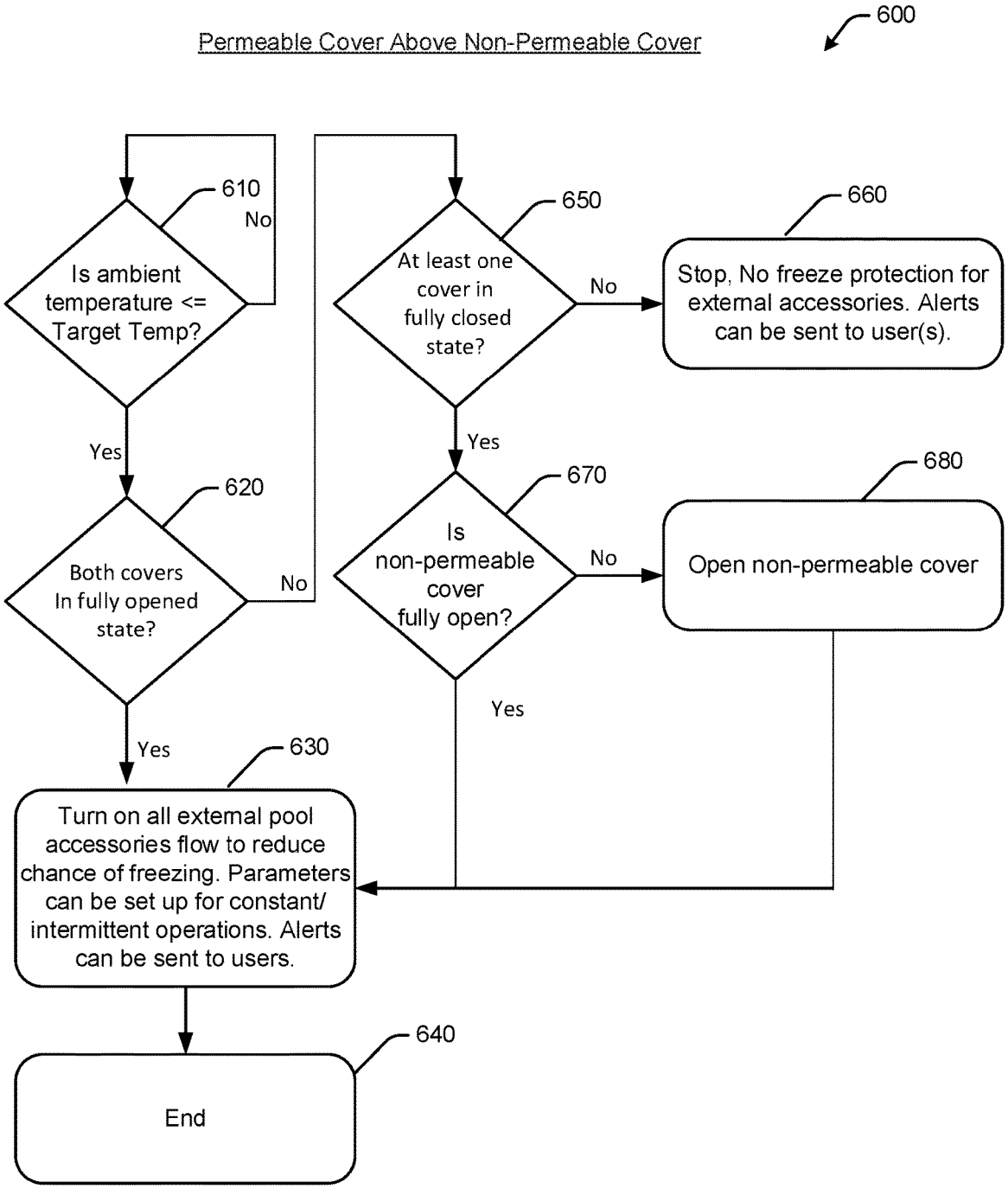

FIG. 6 illustrates example operations that provide freeze protection for all water flow lines, without the concern of water being placed on a non-permeable cover 24 by external water features, which could otherwise damage the cover/tracks/mechanism.

Operations 600 include checking if the ambient temperature is below the target temperature at operation 610. This operation may repeat until the condition is satisfied. If the temperature condition is satisfied (e.g., indicating possible freezing), at operation 620 the protocol checks if both covers are in a fully open state. If both covers are in a fully open state, then operation 630 turns on external pool accessories to reduce the chance of freezing. Operations end at 640 (e.g., when the temperature condition no longer exists or is otherwise turned off by the user).

If both covers are not in a fully open state at 620, then operation 650 checks if at least one cover is in a fully closed state (indicating that no one is in the pool 1). If neither cover is in a fully closed state, then operations stop at 660 for safety reasons, because someone may be in the pool.

If at least one cover is in a fully closed state (indicating that no one is in the pool 1), then operation 680 checks if the non-permeable cover is in a fully open state, and opens the cover at operation 680 if it is not already open. Operations then proceed to freeze protection in operations 630 and 640.

Figure 7:
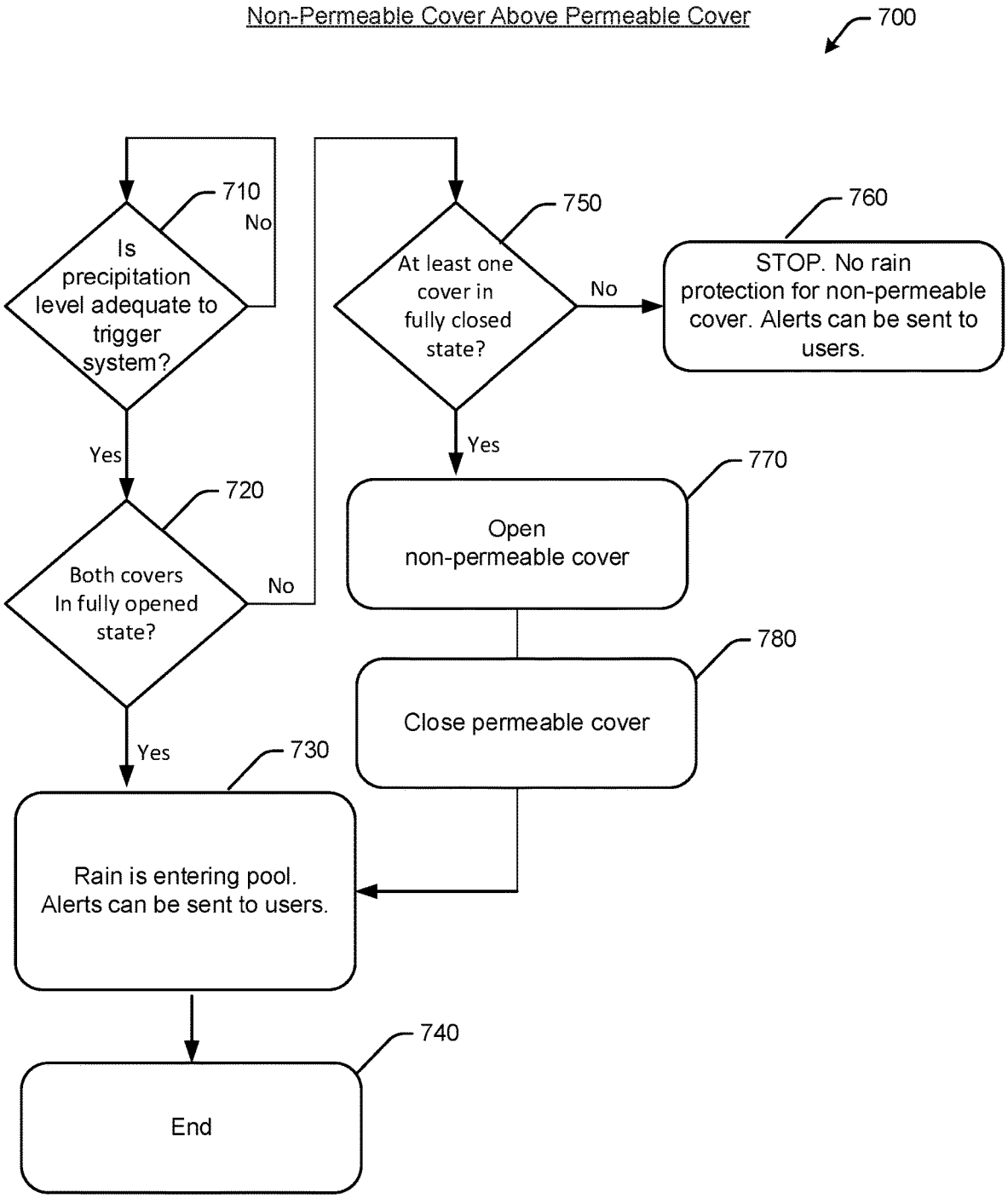
Figure 8:
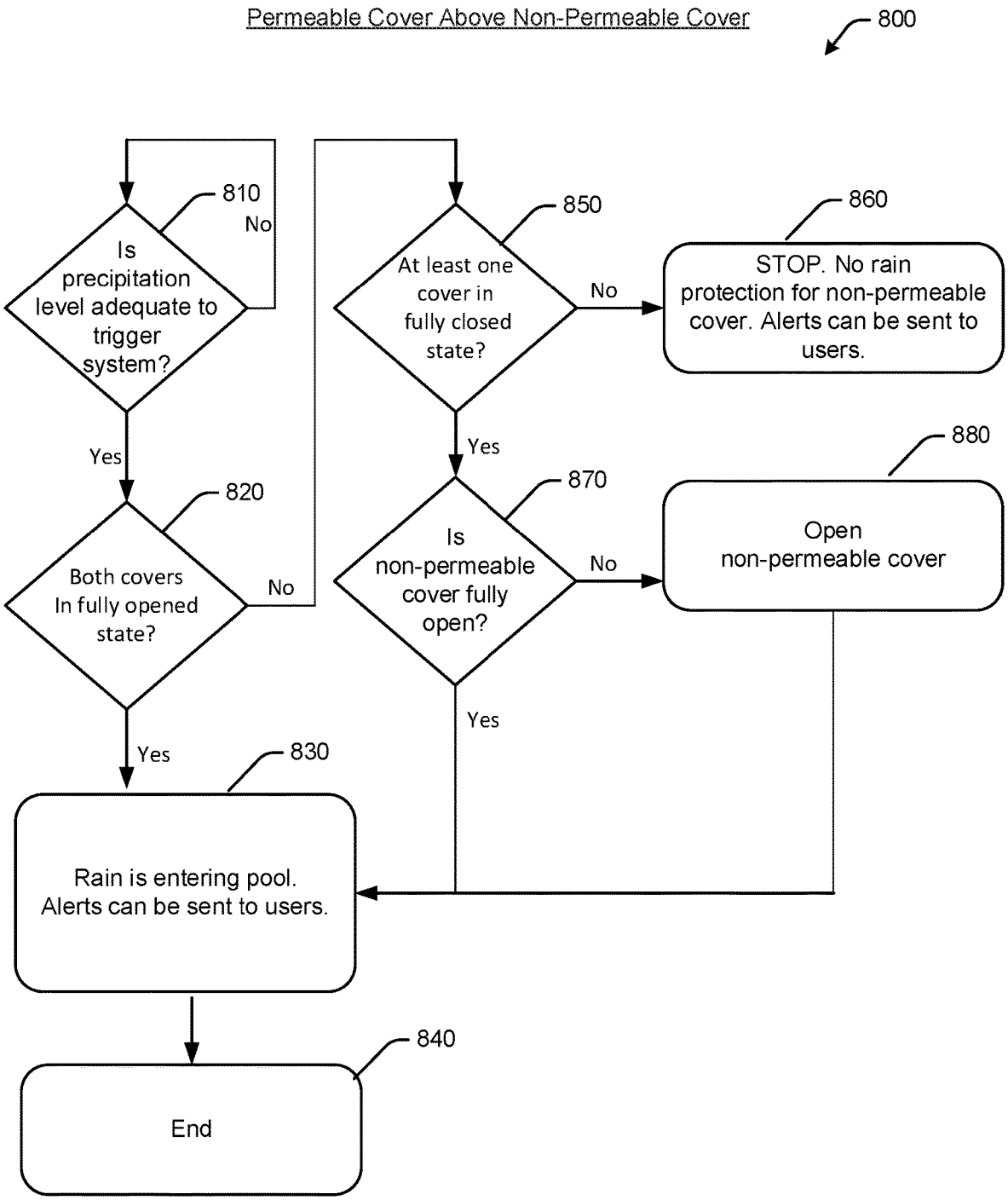

FIGS. 7 and 8 illustrate a similar strategy that can be employed with a dual cover system to protect the non-permeable cover 24 from precipitation damage. In an example, at least one precipitation sensor (e.g., a rain gauge) can be monitored by a pool cover monitoring system. If a predetermined amount of water is accumulating on the non-permeable cover (e.g., exceeding recommended limits provided by the cover manufacturer), the non-permeable cover 24 can be partly or fully opened, temporarily, to allow water to dump into the pool 1 or cover box (e.g., including a drain). In an example, the permeable cover 26 may remain closed. This relieves water weight stress on the non-permeable cover 24, while ensuring a water entry barrier is maintained by the permeable cover 26.

In an example, control logic is operatively associated with the cover 24 and the cover 26. The control logic is configured to receive a signal from the interlock switch 20, 21 and actuate the drive system 14 to move the cover 24 and the cover 26 according to the precipitation protection protocol.

In an example, the non-permeable cover 24 is at least partly opened when a predetermined amount of water is accumulating on the non-permeable cover 26 to allow water to dump into the pool 1 according to the precipitation protection protocol. In an example, the permeable cover 26 is automatically closed to provide an entry barrier. In an example, the permeable cover 26 remains closed to provide an entry barrier and/or barrier to debris.

In an example, at least one motor 16 of the drive system 14 is operated by the control logic to automatically open and close the cover 24 and the cover 26 over the pool 1. In an example, the drive system 14 may include independent motors 16 to separately open and close the cover 24 and the cover 26 over the pool.

In an example, the interlock switch 20, 21 is installed on one or both of the first and second leading edges 22, 23, of the covers 24, 26.

In an example, the cover 24 can be open when the cover 26 is closed. In an example, the cover 24 can be closed when the cover 26 is open. In an example, both the covers 24, 26 can be open and closed at the same time. The position of the covers 24, 26 determines an outcome of the precipitation protection protocol.

Operations 700 include operation 710 checking if the precipitation level on the non-permeable cover is adequate to trigger the precipitation protection, e.g., as monitored by the sensor. Operation 720 includes checking if both covers 24, 26 are in a fully open state. If both covers 24, 26 are in a fully open state, then at operation 730 it is determined that rain is already entering the pool and not accumulating on the non-permeable cover 26. Optionally, the permeable cover may be closed. Alerts may be issued to the user, e.g., via text message or a mobile phone app. Operations end at 740.

If both covers 24, 26 are not in a fully open state at 720, then operation 750 includes checking if at least one of the covers 24, 26 is in a fully closed state. If at least one of the covers 24, 26 is not in a fully closed state, this indicates someone may be in the pool 1. Operations stop at 760 and precipitation protection is not available for safety reasons. Alerts may be issued to the user.

If at least one of the covers 24, 26 is in a fully closed state (i.e., no one is in the pool 1), operation 770 includes opening the non-permeable cover (if this is closed) and/or optionally closing the permeable cover at 780 (if this is closed). Precipitation protection may proceed at operation 730 and end at 740.

Operations 800 include checking if the precipitation level is adequate to trigger the system (e.g., water accumulation on the non-permeable cover) at operation 810. This operation may repeat until the condition is satisfied. If the precipitation condition is satisfied (e.g., indicating possible water accumulation on the cover), at operation 820 the protocol checks if both covers are in a fully open state. If both covers are in a fully open state, then operation 830 confirms that rain is entering the pool and may alert the user. Operations end at 840 (e.g., when the precipitation condition no longer exists or is otherwise turned off by the user).

If both covers are not in a fully open state at 820, then operation 850 checks if at least one cover is in a fully closed state (indicating that no one is in the pool 1). If neither cover is in a fully closed state, then operations stop at 860 for safety reasons, because someone may be in the pool.

If at least one cover is in a fully closed state (indicating that no one is in the pool 1), then operation 880 checks if the non-permeable cover is in a fully open state, and opens the cover at operation 880 if it is not already open. Operations then proceed to freeze protection in operations 830 and 840.

FIGS. 5-8 show example operations wherein identifying that one cover is already closed enables operations to close the second cover. This is based on the logic that having one cover closed means that no one is currently in the pool. However, there are other scenarios where a person may be on the closed cover (e.g., cleaning the cover, retrieving an object such as a child retrieving a toy or ball, etc.).

To further enhance the safety features that accommodate these situations, the operations of FIGS. 5-8 may be modified such that both covers need to be fully closed as evidence to the unmanned system that no one (or animal, or object) would be inadvertently covered by closing the second cover. That is, even if one of the covers is fully closed, but the second cover is not fully closed, the system will not operate either cover as a safety precaution in case someone (or animal or object) is on the cover. This safety feature further serves to ensure that no person (or animal or object) is trapped under the cover or hit by a moving cover. In yet another example, safety sensors may be implemented to operate a reversing switch in the event that a moving cover encounters a person (or animal or object).

It is noted that the examples shown and described are provided for purposes of illustration and are not intended to be limiting. Still other examples are also contemplated.

The invention claimed is:

1. A pool double safety cover with protection protocol, comprising:

a first cover that is substantially impermeable to water;

a second cover that is substantially permeable to water;

a track system having independent parallel tracks for guiding the first cover and the second cover to open and close over a pool;

at least one interlock switch configured to generate a signal indicating whether the first cover and the second cover is in a fully open or fully closed state;

a temperature sensor;

a drive system to open and close the first cover and the second cover over the pool according to a freeze protection protocol based on feedback from the at least one interlock switch and the temperature sensor.

2. The pool double safety cover of claim 1, further comprising control logic operatively associated with the first cover and the second cover, the control logic configured to receive a signal from the at least one interlock switch and the temperature sensor, the control logic further configured to actuate the drive system to operate the first cover and the second cover according to the freeze protection protocol.

3. The pool double safety cover of claim 2, wherein external pool accessories are turned on automatically when both covers are in a fully open state, to maintain water flow through water lines of the external pool accessories and reduce freezing of the external pool accessories according to the freeze protection protocol.

4. The pool double safety cover of claim 2, wherein the non-permeable cover is automatically opened according to the freeze protection protocol when both covers are in a fully closed state.

5. The pool double safety cover of claim 4, wherein external pool accessories are turned on automatically after opening the non-permeable cover to maintain water flow through water lines and reduce freezing of the external pool accessories according to the freeze protection protocol.

6. The pool double safety cover of claim 2, further comprising at least one motor operated by the control logic to automatically open and close the first cover and the second cover over the pool.

7. The pool double safety cover of claim 6, further comprising independent motors to separately open and close the first cover and the second cover over the pool.

8. The pool double safety cover of claim 1, further comprising a first leading edge for the first cover, and a second leading edge for the second cover, wherein the at least one interlock switch is installed on one or both of the first and second leading edges.

9. The pool double safety cover of claim 1, wherein the first cover can be open when the second cover is closed, the first cover can be closed when the second cover is open, and both the first and second covers can be open and closed at the same time, wherein the position of the first and second covers determines an outcome of the freeze protection protocol.

10. The pool double safety cover of claim 1, further comprising control logic operatively associated with the first cover and the second cover, the control logic configured to receive a signal from the at least one interlock switch and actuate operation of the first cover and the second cover according to a precipitation protection protocol based on feedback from at least one precipitation sensor.

11. A pool double safety cover with protection protocol, comprising:

a first cover that is substantially impermeable to water;

a second cover that is substantially permeable to water;

a track system having independent parallel tracks for guiding the first cover and the second cover to open and close over a pool;

at least one interlock switch configured to generate a signal indicating whether the first cover and the second cover is in a fully open or fully closed state;

a precipitation sensor;

a drive system to open and close the first cover and the second cover over the pool according to a precipitation protection protocol based on feedback from the precipitation sensor and the at least one interlock switch.

12. The pool double safety cover of claim 1, further comprising control logic operatively associated with the first cover and the second cover, the control logic configured to receive a signal from the at least one interlock switch and actuate the drive system to move the first cover and the second cover according to the precipitation protection protocol.

13. The pool double safety cover of claim 12, wherein the non-permeable cover is at least partly opened when a predetermined amount of water is accumulating on the second cover to allow water to dump into the pool according to the precipitation protection protocol.

14. The pool double safety cover of claim 13, wherein the first cover is automatically closed to provide an entry barrier.

15. The pool double safety cover of claim 13, wherein the first cover remains closed to provide an entry barrier.

16. The pool double safety cover of claim 12, further comprising at least one motor operated by the control logic to automatically open and close the first cover and the second cover over the pool.

17. The pool double safety cover of claim 16, further comprising independent motors to separately open and close the first cover and the second cover over the pool.

18. The pool double safety cover of claim 11, further comprising a first leading edge for the first cover, and a second leading edge for the second cover, wherein the at least one interlock switch is installed on one or both of the first and second leading edges.

19. The pool double safety cover of claim 11, wherein the first cover can be open when the second cover is closed, the first cover can be closed when the second cover is open, and both the first and second covers can be open and closed at the same time, wherein the position of the first and second covers determines an outcome of the precipitation protection protocol.

20. The pool double safety cover of claim 11, further comprising control logic operatively associated with the first cover and the second cover, the control logic configured to receive a signal from the at least one interlock switch and actuate operation of the first cover and the second cover according to a freeze protection protocol based on feedback from at least one temperature sensor.

* * * * *